US007257931B2

(12) United States Patent
Jones

(10) Patent No.: US 7,257,931 B2
(45) Date of Patent: Aug. 21, 2007

(54) GYPSUM WALL HOLE FILLER

(76) Inventor: Jeff Jones, 11582 Marjon Dr., Nevada City, CA (US) 95959

( * ) Notice: Subject to any disclaimer, the term of this patent is extended or adjusted under 35 U.S.C. 154(b) by 454 days.

(21) Appl. No.: 10/741,892

(22) Filed: Dec. 19, 2003

(65) Prior Publication Data

US 2005/0144876 A1 Jul. 7, 2005

(51) Int. Cl.
*E02D 37/00* (2006.01)
*E04G 23/02* (2006.01)

(52) U.S. Cl. ..... 52/514.5; 52/742.1

(58) Field of Classification Search ..... 52/514, 52/514.5, 741.1, 742.1; 425/318; 156/94, 156/98, 71, 579
See application file for complete search history.

(56) References Cited

U.S. PATENT DOCUMENTS 3,583,122 A * 6/1971 Biegajski ..... 52/514
4,075,809 A * 2/1978 Sirkin ..... 52/514
4,471,594 A * 9/1984 Doyle ..... 52/514
5,033,949 A * 7/1991 Jewett ..... 425/12
6,347,496 B1 * 2/2002 Pinkins ..... 52/514

* cited by examiner

*Primary Examiner*—Jeanette E. Chapman
*Assistant Examiner*—Elizabeth A Plummer
(74) *Attorney, Agent, or Firm*—Mark C. Jacobs, Esq.

(57) ABSTRACT

A device for patching wall holes caused by a doorknob or other item impact, which device is assembled in situ between the injured wall member and an adjacent rear wall member. A master plate having a circular opening with four ninety-degree apart radiating outward slots, is adhered to the interior face of the injured wall over the opening. Two inter-engageable body sections each having a tongue are centrally inter-engaged at right angles and retained by placement of a disk designated the central section having a central internal cross-shaped cutout over the engaged tongues. The disk bearing engaged body sections are recessed into the master plate up to the tongues, rotated and locked into position between the wall members. Spackle or plaster is applied, allowed to dry, and then painted/papered to yield a non-discernable repair is applied, allowed to dry and then painted or papered over to yield a non-discernible repair.

12 Claims, 10 Drawing Sheets

GYPSUM WALL HOLE FILLER

FIELD OF THE INVENTION

This application pertains to a device for filling in a hole in a gypsum board wall member to retain a spackled patch.

BACKGROUND OF THE INVENTION

Due to negligence, accidents, or anger people find from time to time that a doorknob being opened inwardly smashes into the adjacent wall often making at least an indentation and often a hole in the wall member. Such holes are difficult to patch, as there is a no base for SPACKLE to stick to. The device of this invention fits in the hole between the injured front interior wall member and the rear wall member of the wall to provide a substrate for receipt of SPACKLE such that the hole can be completely filled in and painted or papered over as needed.

There is also a need to fill in holes even bigger than a conventional doorknob. This device permits holes as large as six inches in diameter to be filled in prior to spackling.

It is a first object to define a device to fill in a hole made by a doorknob.

It is a second object to provide a device that is mounted between an interior injured wall member and the wall member spaced away adjacent thereto.

It is a third object to provide a device that permits the user to fill a hole in the wall between a void front wall member and its sister spaced away interior member.

It is a fourth object to provide a device that permits the hole from a doorknob impression to be readily filled in.

It is a fifth object to provide a support for Spackle for the repair of apertures in a wall having been injured by projectile such as a fist, a fast-moving doorknob or even a bullet.

The device of this invention indeed serves as a base for the repair of such holes in an interior gypsum board wall. And a novice can carry out the job.

The invention accordingly comprises the device possessing the features, properties, the selection of components which are amplified in the following detailed disclosure, and the scope of the application of which will be indicated in the appended claims.

For a fuller understanding of the nature and objects of the invention, reference should be made to the following detailed description, taken in conjunction with the accompanying drawings.

SUMMARY OF THE INVENTION

A device for filling the hole in the interior gypsum board wall member to retain a spackled patch. The device is formed from four members made of various materials such as but not limited to plywood, sheets plastic, chipboard, water resistant corrugated board and cardboard, and artists' board assembled in a specific fashion and of specific dimensions for two of the members. A first member, designated the master plate, is adhered to the interior of the injured wall, followed by the insertion through the master plate of two body members each of which is a tongue bearing centrally inter-engaged body section, having a an interlocking disk thereon. The so engaged body members with disk thereon are designated a material receiver. The disk carrying engaged members (material receiver) is rotated into a secure position. Spackle or plaster is added; paper or paint is applied to yield a non-discernible repair.

It is a first object to provide a low cost, easy to install wall hole repair device.

It is a second object to provide a wall hole repair device that yields an invisible repair once paint or wallpaper is applied.

Other objects of the invention will in part be obvious and will in part appear hereinafter.

DESCRIPTION OF THE PREFERRED EMBODIMENT

The device 10 of this invention is intended to serve as a support for spackle in the repair of an interior gypsum wall board that has an aperture therein due to the door handle having impacted against the wall member, for such reasons as the failure of anger management, accident or due to negligence.

In this patent application the term interior wall refers to two closely spaced wall members, each usually made of gypsum board. The device of this invention as described fits between the two spaced gypsum board members of the wall.

Figure 1:
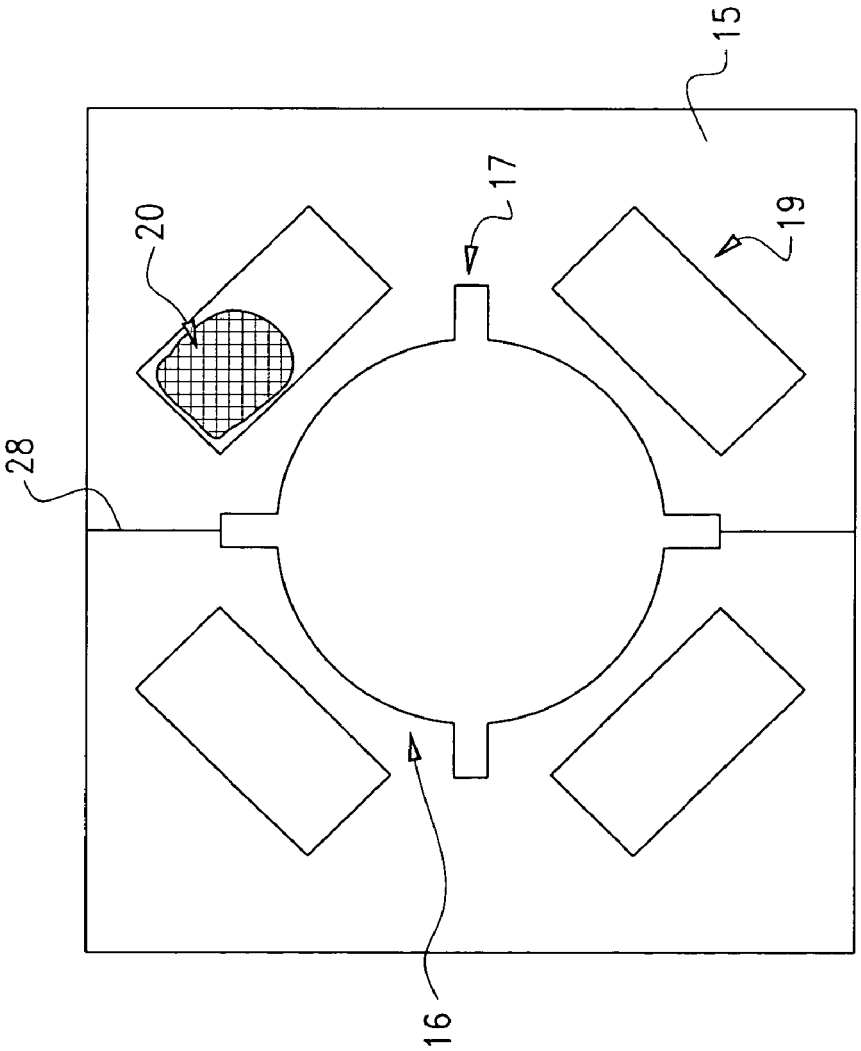
FIG. 1 is a front plan view of the master plate body portion.

In FIG. 1, a sheet of artists' foam board or the suitable material cut to the desired size is designated as the master plate, 15 is seen on its obverse side. This side may be made distinguishable from the reverse side by providing for the presence of the score line 28, which, if present, is scribed from the outer edge of the plate 15, through the center of either pair of rectangular openings 17 the purpose for which will be discussed infra. The center opening 16 of the master plate is about two inches in diameter, is seen which opening communicates with a series of small rectangular openings 17 disposed at each of the 90 degree positions around the center opening. These four slots 17 radiate outwardly from the opening 16, ninety degrees apart. Disposed adjacent to each pair of rectangular openings 16 is a piece of self adhesive tape 19 approximately 1 inch by 1.5 inches. A peelable cover sheet 20 is disposed over each adhesive layer to prevent the glue from sticking to other than the desired surface, which in this case is a piece of gypsum board. As will also be discussed infra in the section of this application dealing with installation the overall size of the artist foam board or other board is not critical, but should be between about 4.75 to 6 inches for ease of packaging and ease of use.

Figure 2:
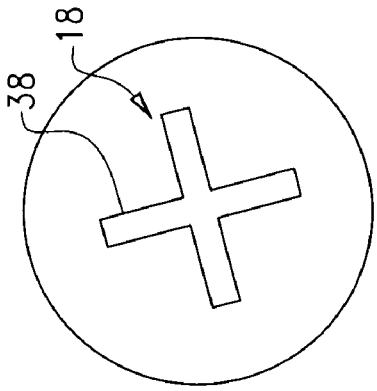
FIG. 2 is a plan view of the circular front central section of this invention.

In FIG. 2 the central section is seen. This section is a piece of artist foam board 18 that has been removed from the master plate 15 and modified. The central section 18 has a central internal x-shaped cutout therein designated 38.

Figure 4:
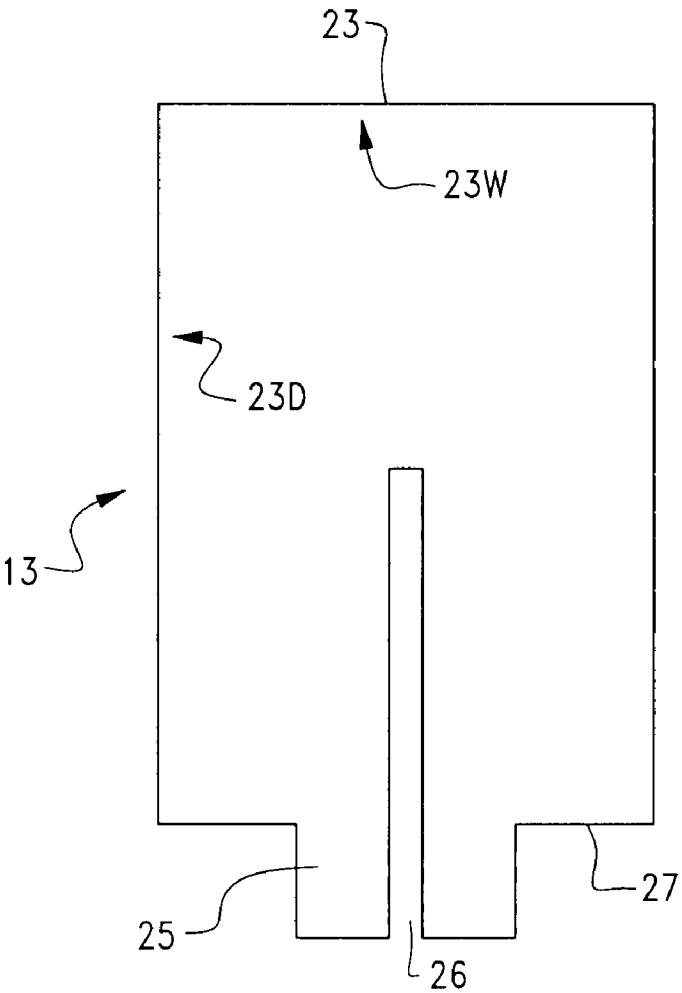
FIG. 4 is a plan view of the body member B.
Figure 3:
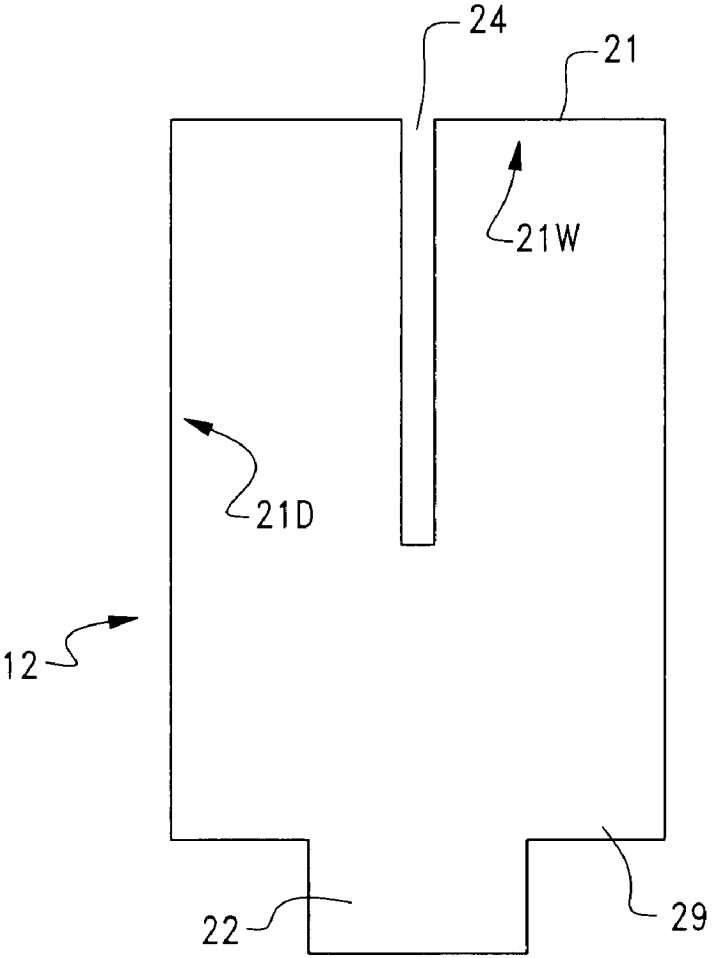
FIG. 3 is a plan view of the body member A.

In FIGS. 3 and 4, the body members, 12,13 comprising the mating planar tongue bearing body sections 21 and 23 are seen. These are die cut sections also of artists' foam board that are of the same physical dimensions. The width of each of 21 and 23 designated 21W and 23W respectively may be about 2.5 inches, while the depth of each 21D and 23D respectively may be about 3 inches, though the depth excludes the tongue to be discussed next.

The depth measurements of 21D and 23D constitute the distance from the inside of the broken front wall (re the wall to be repaired) measured to the inside surface of the spaced adjoining area or room interior wall, minus the thickness of the master plate 15. These are the depth measurement for both the 2×4-studded walls and 2×6-studded walls.

Figure 5:
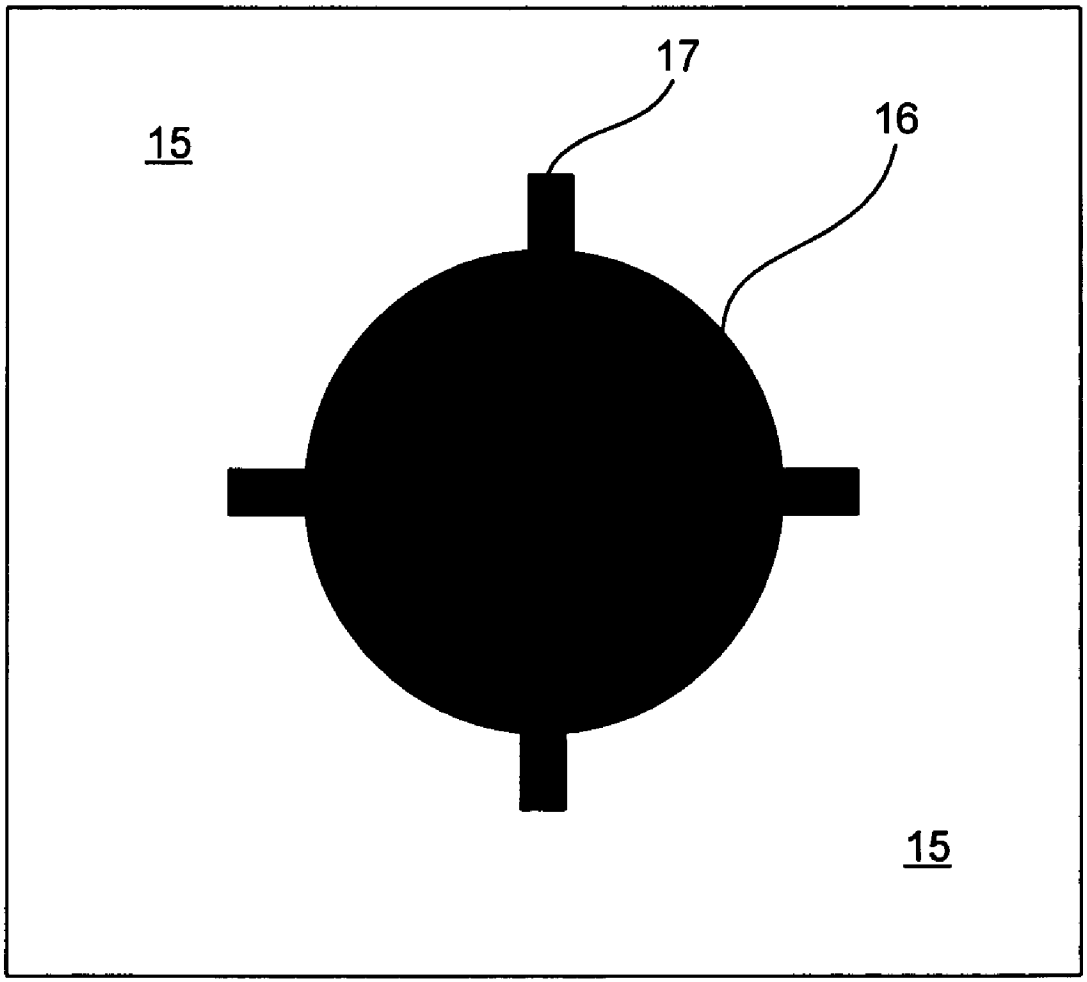
FIG. 5 is a rear plan view of the master plate.

Each body member's body section has a centrally disposed rectangular tongue that is contiguous with and attached to the respective front edge 27,29 per FIG. 4, respectively of the width of the body section. Such tongues 22,25 are in the same respective plane as each of the body sections and are about ½ inch in depth and 1 inch in width, which is a smaller diameter than the width of the body section. The two body sections differ in that section 21 has an inwardly directed slot 24 on the rear width edge opposite its tongue directed parallel to the side edges; while body section 25 has an inwardly directed slot 26 on the front edge through the tongue into the body. Both slots 24,26 are of equal extension. When engaged, the two body sections are vertically engaged along their central axis to form a plus sign (+) shaped unit;

In FIG. 5, the reverse side of the master plate 15 is seen. Here the score line 28 is not seen. "Only the center opening and the center opening and the communicating 90 degrees apart little rectangular slots or openings are seen."

Figure 6:
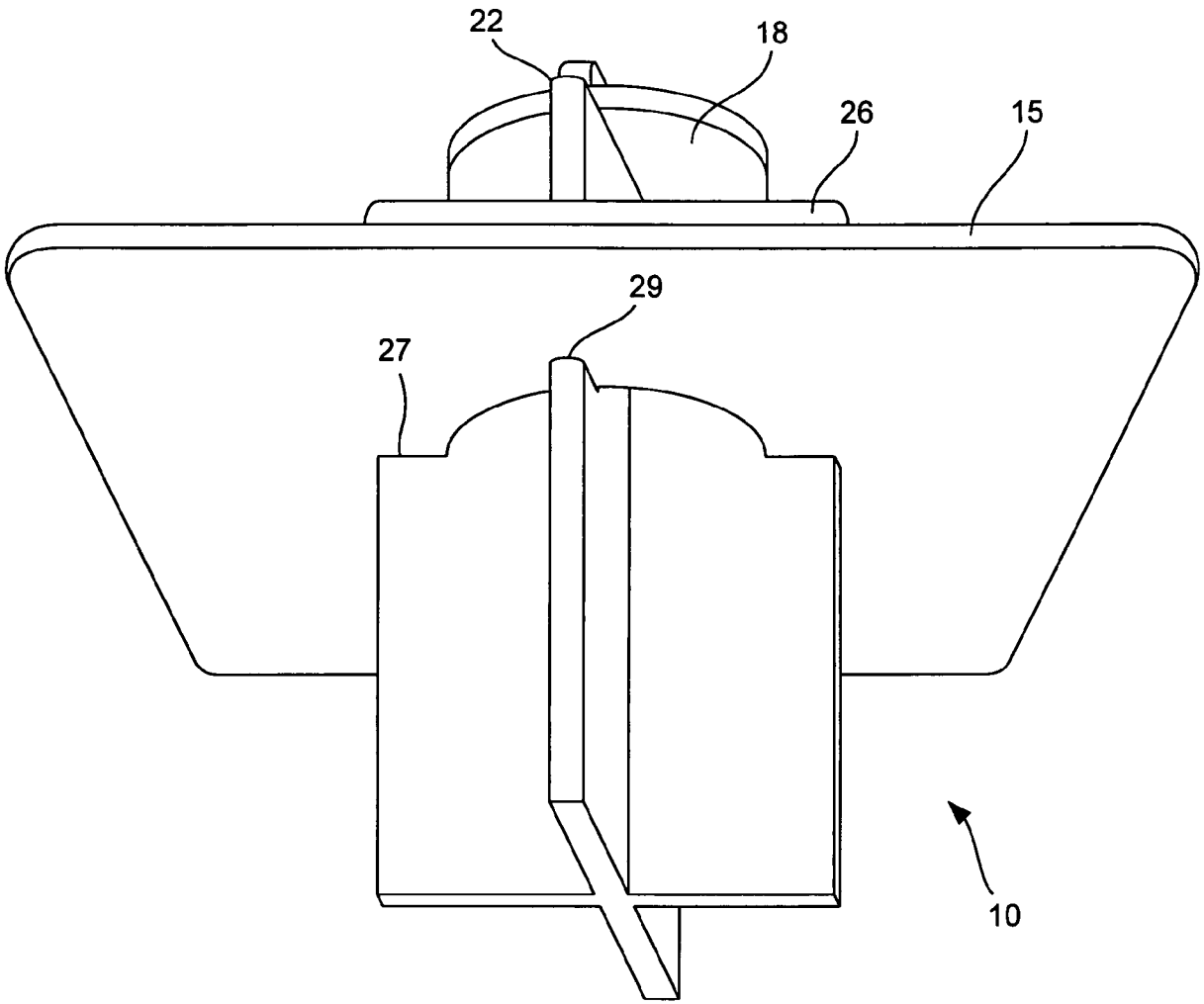
FIG. 6 is a side elevation of the inventive device disposed in a wall.

In FIG. 6, a side elevational view of an assembled unit of this invention is seen. The two-interlocked body sections 21,23 are assembled to form a cross, and the two outer edges of each of the body sections are disposed within a respective slot 17. The central section or disk 18 seen in FIG. 2 is disposed via its cross opening 38 upon the crossed tongues 22,25 and rests on the respective front edges 27,29 of the body sections 21, 23. The respective crossed tongues protrude through the T-slot 38 in central section 18. When the disk is placed on the plus sign (+) crossed body sections, a material receiver is defined see also FIG. 2.

Figure 7:
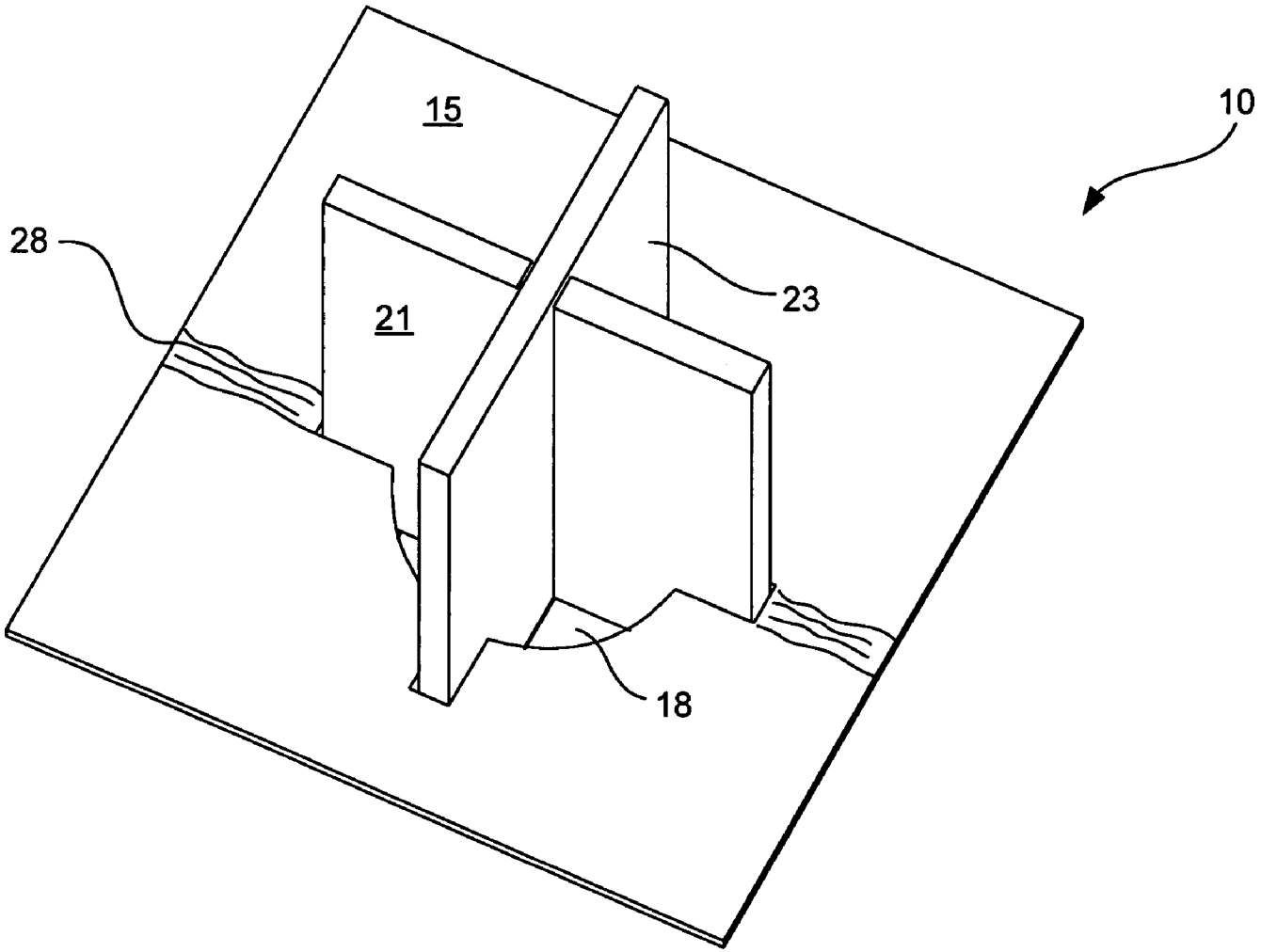
FIG. 7 is a rear perspective device of the assembled invention of this application.

FIG. 7 illustrates the reverse side of the master plate 15 and the crossed interconnected main sections 21 and 23 having the master plate 15 disposed thereon. The master plate 15 is placed thereon from the bottom of the edge of the main sections that do not have a tongue, by aligning the four 90 degrees spaced slots with the crossed body sections, 21, 23. When installation is to transpire, this should be done from the obverse side of the master plate 15.

Figure 8:
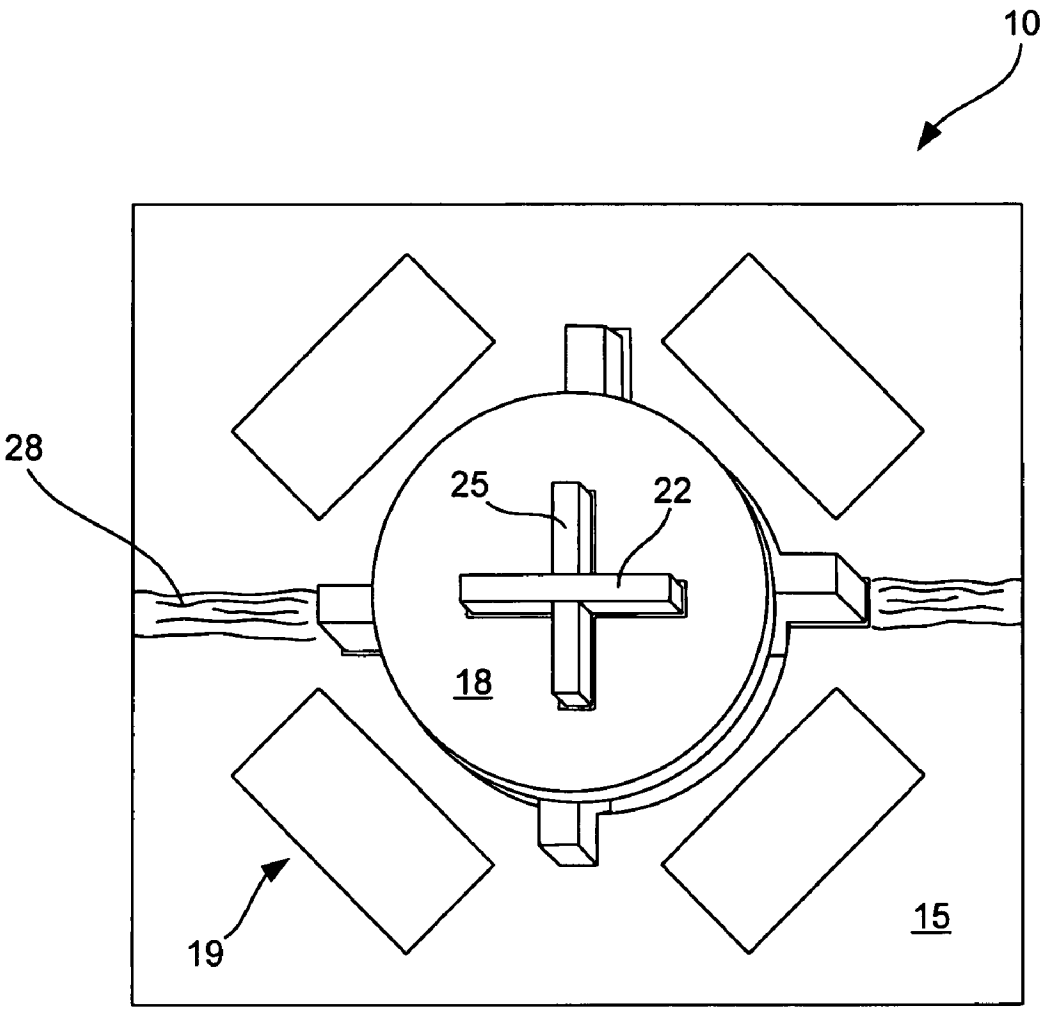
FIG. 8 is a front perspective view of the assembled invention of this application.

In FIG. 8, the device of this invention is seen in a partially assembled condition, but not in an in-wall environment. The front or obverse face of the master plate 15 is seen with the self-adhesive tabs 19 still covered over. Plate 15 is spaced back from the edge of the disk 18. During installation it, 18 is disposed a distance back from the front edges of members 21 and 23 and placed thereon in the hole in the gypsum board.

It is also to be seen that while in FIG. 8 the assembly of the two members shown in FIGS. 3 and 4 have been carried out, and the center section has been placed thereover. It is also within the scope of the invention to mold the two members, 18 21, and 23, with the center section thereon, as one preformed member. See FIG. 13 wherein the preformed unitary structure 101 has its three components designated in the 100 series numbers, 118,121, and 123 respectively.

While the unitary structure 101 falls within the scope of the invention as to utilization, a different packaging is required but with less assembly by the user.

Figure 9:
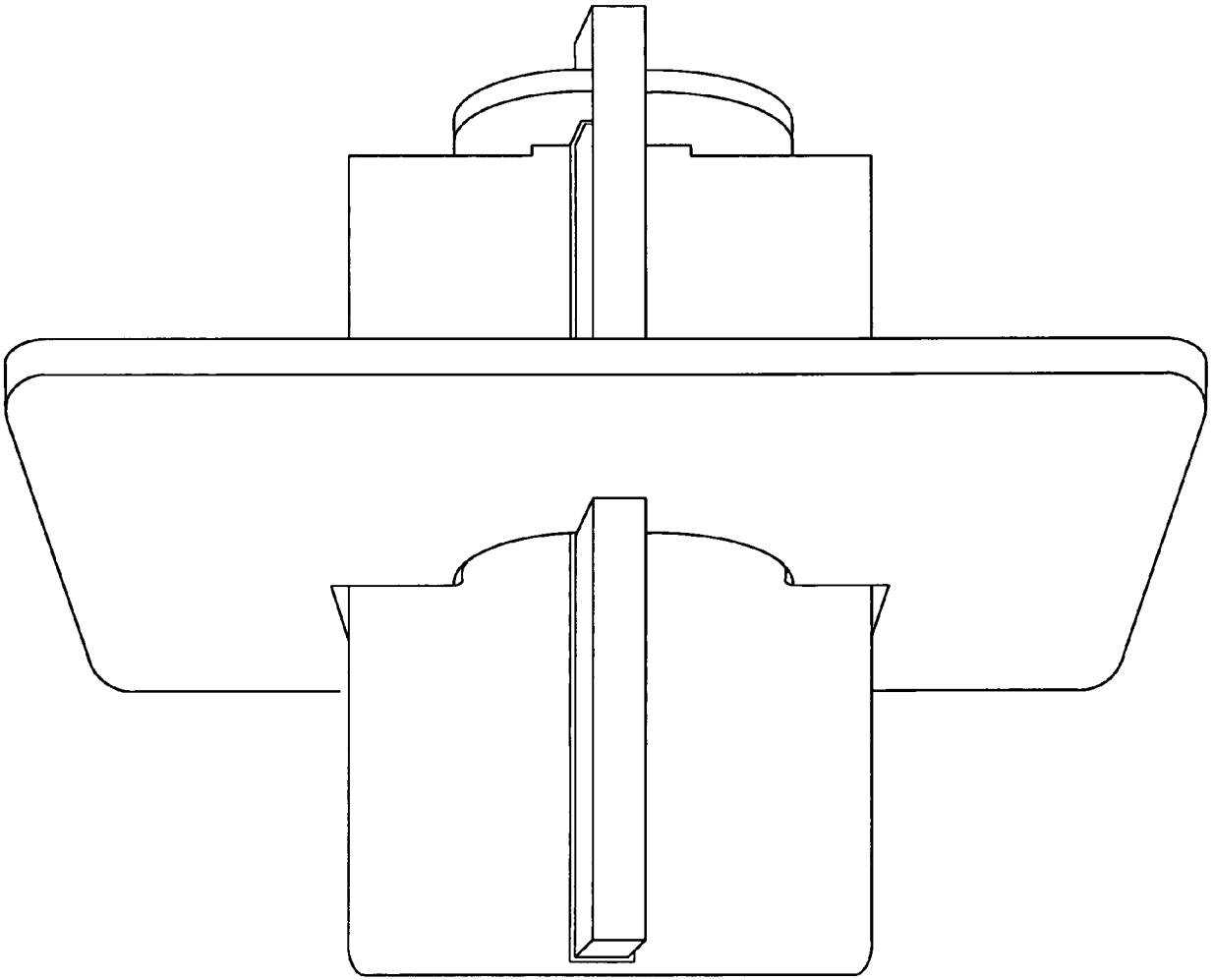
FIG. 9 is a top perspective view of the assembled invention.

FIG. 9 is a mirror image of FIG. 6 and need not be discussed further.

Figure 10:
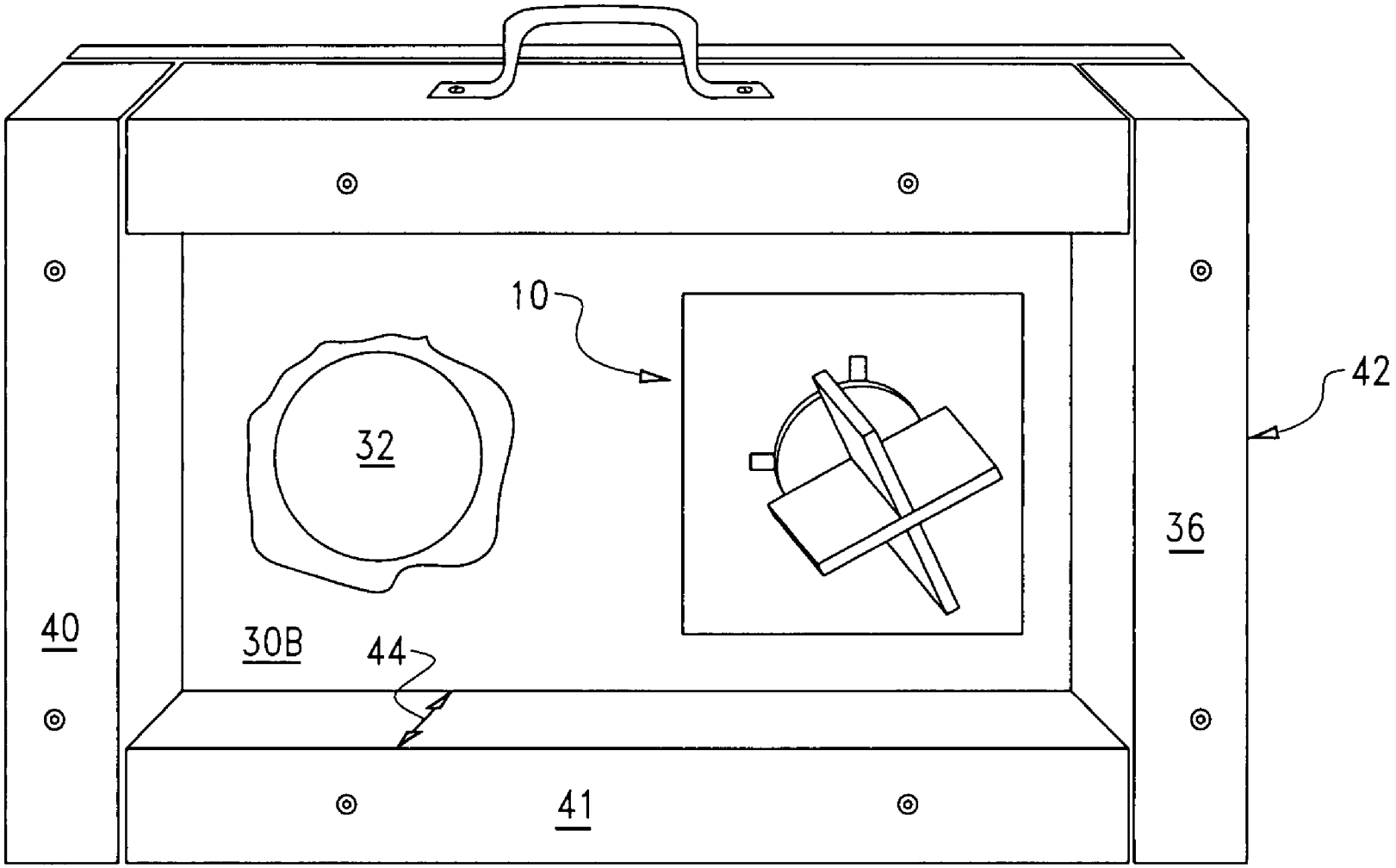
FIG. 10 is a rear perspective view of the installed invention in a wall.

FIG. 10, is a view that simulates a wall thickness. Designator 30B stands for the backside of the gypsum board wall 30 having a hole 32 therein to be repaired. Surrounding the hole 32 is a pair of spaced studs 36,40, which is present. A cross beam 41 may be disposed, but need not be, between the two studs aforementioned. Device 10 is seen through the pseudo wall 42, which is spaced from the front wall's backside 30B. The pseudo wall here 42 is a sheet of clear acrylic that simulates the second spaced piece of gypsum board, which helps define the space 44 between the two gypsum board sheets making up a wall thickness of a room.

The right side part of FIG. 10 illustrates a previously installed unit of this invention as seen from within the wall between the opposed gypsum boards, in front of back wall shown here as being clear. Reference will be made back to FIG. 10 at the completion of the discussion of the individual figures.

Figure 11:
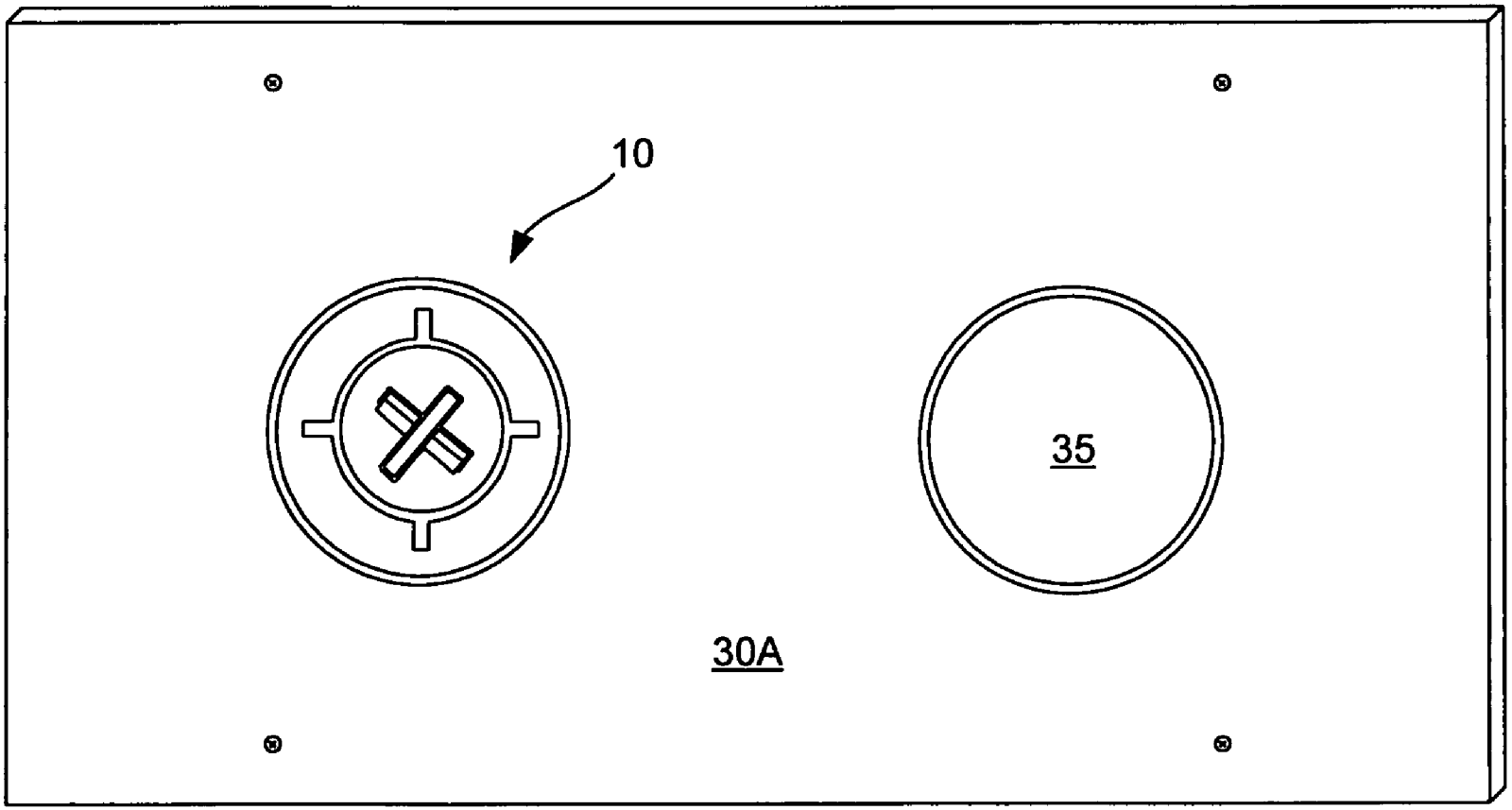
FIG. 11 is a front perspective view of the assembled installed invention.

FIG. 11 illustrates the front side of the wall 30, namely 30A. Thus, the busted in segment of the wall 30 as designated 32 in the left of FIG. 10 is seen on the right in FIG. 11. The position of the previously installed unit of the invention 10 is also reversed from FIG. 10 to FIG. 11. The relative position of the master plate 15 subsequent to installation is visible in FIG. 10. As can be seen, the master plate and the disk are coplanar post installation.

Figure 12:
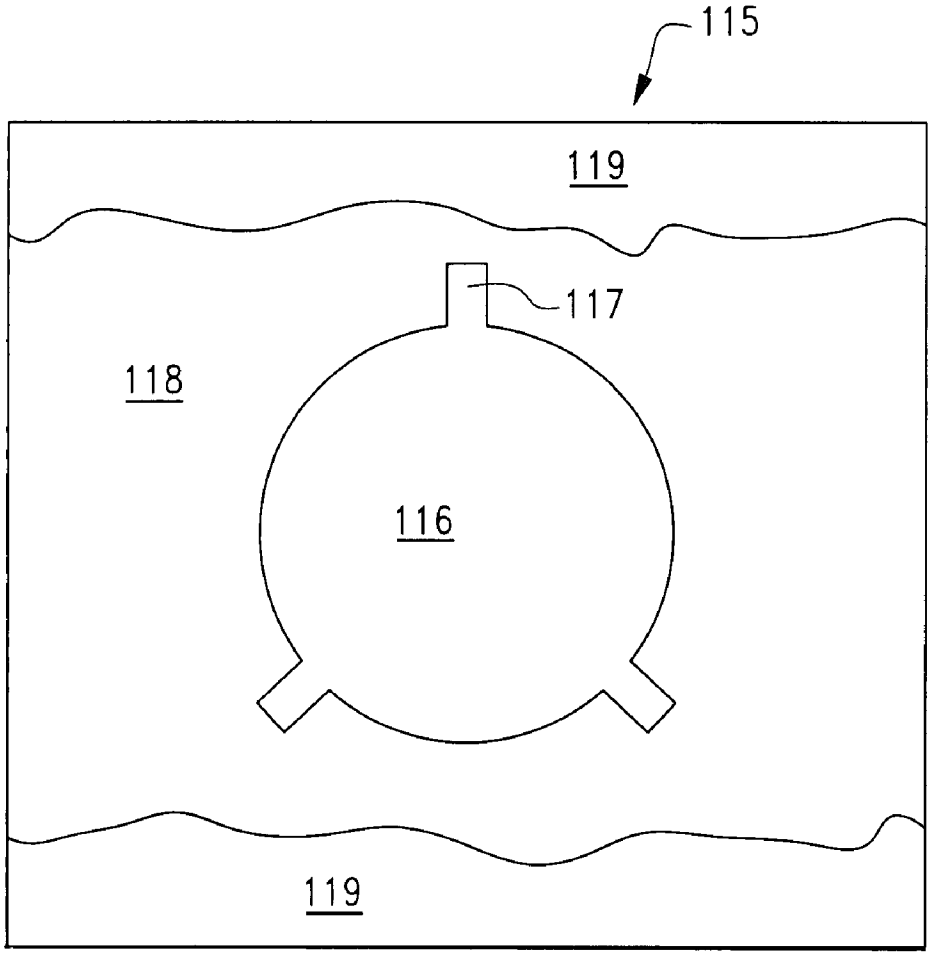
FIG. 12 is a view of an alternative construction of the master plate.

In FIG. 12 the master plate 115 is seen. Here the entire surface of the foam board or other material 118 is covered over by an adhesive layer 119. The cutaway lines reveal the presence of the underlying layer 118. The central opening 116 three 120 degree apart radiating outwardly slots 117. A peelable cover layer to protect the adhesive from unintentional contact would be used but is not shown.

Figure 13:
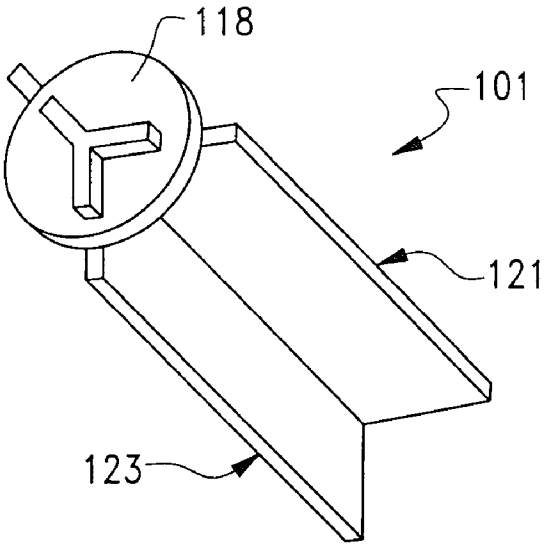
FIG. 13 is a perspective view of several of two body members formed as an integrated unit as by casting.

In FIG. 13, the two body sections are seen in perspective formed as an integral unit, 121 as by casting or molding of resin with three legs instead of four. In addition it may also be possible to have the disk or central section also integrally molded in place on the unified body section 121 and such is contemplated by this invention.

Installation

In order to set up the device of this invention within its work environment,—between two spaced sections of gypsum board, a set of steps must be carried out, though not necessarily in the same order as recited. After removing the adhesive cover layers 20, the master plate 15 is folded along the score line 28, if present, and disposed through the opening equivalent to 32 where the hole was made as by a doorknob impact, or a punch or other mode into the front wall member 30 to require a repair to be made. The master plate with its circular opening and four ninety degree apart radiating outward slots is held through the center opening 16 with a pair of fingers, and then opened such that the four uncovered adhesive tabs face the operator. The plate is brought toward the viewer to make contact between the exposed adhesive tabs and the wall 30B to attach the master plate 15 into position.

By folding the master plate such that the glue containing sections move away from each other, the four cover plates may be removed prior to disposition through opening 32, this way contact of one adhesive tab with another such tab is avoided.

After the master plate is positioned affixed to wall 30B, the two body sections A and B, designated 21 and 23 are inter-engaged and placed into the four slots 17, moving rearwardly part way away from the user. Disk 18 is placed over the crossed body sections A and B to yield a material receiver. The rearward journey of the two inter-engaged body sections with the disk is restarted and continued until impact is made with wall 41. This point in time should coincide with the location of the disk almost approaching a coplanar status with the master plate 15. The crossed tongues should be the only parts of the two inter-engaged body sections now visible.

Using two fingers, on the two tongues, the inter-engaged body sections, are rotated about 45 degrees, once the front edges 27 and 29 clear the slots 17, to lock the main body sections between the two pieces of gypsum board constituting the injured wall member and the rear wall member of the wall. See FIG. 10, right side. The rearward travel to the inter-locked body sections is continued until the disk 18 becomes coplanar with the body section. See FIG. 11. Note the lack of coordination in FIG. 11 of the two tongues and the slots 17. Once the device 10 is locked into position, such that it cannot fall rearwardly down into the void between the two spaced gypsum board wall members, Spackle or plaster can be applied over the disk and the showing portion of the master plate. These serve as a backer plate for the reception of the Spackle or plaster and as a permanent brace to strengthen and resist future impacts from a doorknob. Once filled and dried, the spackle or plaster does not require feathering and can be sanded and painted to complete the repair of the impacted doorknob or fist, or other source of the hole. Reference is made to designator 35 in FIG. 11, which illustrates a completed repair.

It is believed that other step orders can be carried out to place device 10 between the spaced sheets of gypsum board, though more difficulty may be encountered in doing so.

While artists' foam board has been mentioned as the preferred material for the structure, other materials such as sheet styrene or other plastic may be employed for all sections as will as chipboard, plywood, and cardboard. A waxed corrugated board to prevent swelling from the moisture of the Spackle may also be utilized for all parts of the invention.

Any latex paint or oil paint may be applied to the patch created by the use of this device.

Earlier, it has been indicated that the device 10 is suitable for the repair of holes having a diameter as large as about six inches. This is based upon two facts. First, the most common diameter for doorknobs found in the USA is about two inches in diameter. Thus, if the hole radiates out from a central point of impact, an allowance of an extra two inches of damage to the left and right of the knob yields or six inch diameter circle. Accordingly, the master plate 15 has been sized preferably at 6×6 inches before folding in anticipation of such possible drywall crackages. Obviously, the master plate can be enlarged laterally to cover larger spans up to perhaps sixteen inches wide, but with the same depth.

In the discussion supra concerning FIG. 1, an alternative mode of construction is seen in the side view FIG. 12. Here a self-adhesive layer 119 is disposed over the entire master plate 115. The self-adhesive layer 119 is overlaid with a peel off cover layer 120. Such a variant can be produced by a spraying technique for the adhesive layer 119 rather than having the tab 19 laid in place by hand or machine. This format works for a four-legged unit as well as the three-legged unit shown.

Other modes of attachment of the master plate are also contemplated, such as a layer of removable adhesive overlaid on the master plate 15 though one having a stronger adhesive quality than is used on Post-it® notes is needed. Removable adhesive is suggested or slow drying adhesive to compensate for errors of the person doing the repairs.

Previous reference has been made to a score line. This line may be actually required, depending upon the material employed of the master plate. The benefit of having a score line is that a fold generally along such a line as desired is ensured. In certain materials, due to the preexistence of the ¼ hour opening and the center opening, a true fold may be easily accomplished. Such is not the case however wherein the substrate for the master plate 15 is sheet plastic, or a plywood segment. Card stock or corrugated board should fold easily in contrast without the need for a true score line 28.

While in general the same material will be used for all of the elements of this invention, they need not be so manufactured.

Since certain changes may be made in the described apparatus without departing from the scope of the invention herein involved, it is intended that all matter contained in the above description and shown in the accompanying drawings shall be interpreted as illustrative and not in a limiting sense.

I claim:

1. A device for patching holes in a wall member caused by a doorknob or related item impact, which device comprises:

[a] a master plate having adhesive on one surface and having a circular opening with four ninety-degree apart radiating outward slots emanating from said circular opening;

[b] a pair of body members comprising vertically inter-engageable body sections, each having a tongue of a width smaller than the body section, such that when the body members are engaged along their central axis they form a plus sign (+) shaped unit;

[c] a disk having a central internal plus (+) shaped cutout, sized to engage the crossed tongues of said body members, and when so placed defines a material receiver, whereby after the master plate is passed through a hole in the wall member and adhered over the hole, the engaged body sections with the disk thereupon, now designated a material receiver, is inserted into the radiating outward slots, up to the two respective tongues, and then rotated, the material receiver is locked into position for the receipt of spackle or putty.

2. The device of claim 1 wherein one body member has a central upwardly directed vertical slot and one body member has a downwardly directed central slot for the inter-engagement.

3. The device of claim 1 wherein the two body members are formed as one integral unit, instead of comprising vertically inter-engageable body sections.

4. The device of claim 1 wherein the master plate has one surface covered with adhesive, and a peelable cover layer overlays said adhesive.

5. The device of claim 1 where in the adhesive is a series of spaced tabs each with its own peelable cover layer thereon.

6. The device of claim 1 wherein the master plate has a score line to facilitate folding for placement within the hole in the wall member.

7. A device for patching holes in a wall member caused by a doorknob or related item impact; which device comprises:

[a] a master plate having a central score line, and a plurality of spaced adhesive tabs on one surface and having a circular opening with three one hundred twenty-degree apart radiating outward slots emanating from said circular opening;

[b] a pair of body members comprising vertically inter-engageable body sections, each having a tongue of a width smaller than the body section, such that when the body members are engaged along their central axis they form a Y shaped unit;

[c] a disk having a central internal Y shaped cutout, sized to engage the crossed tongues of said body members, and when so placed defines a material receiver, whereby after the master plate is passed through a hole in the wall member, and adhered over the hole, the engaged body sections with the disk thereupon, now designated a material receiver, is inserted into the radiating outward slots, up to the two respective tongues, and then rotated, the material receiver is locked into position for the receipt of spackle or putty.

8. The device of claim 7 wherein the body members, the disk and the master plate are made of artist's board.

9. The device of claim 7 wherein one body member has a central upwardly directed vertical slot and one body member has a downwardly directed central slot for the inter-engagement.

10. The device of claim 8 wherein the body unit has three legs situated one hundred twenty degrees apart.

11. The device of claim 7 wherein the body members, the disk and the master plate are all made from the same material.

12. The device of claim 11 wherein the material is selected from the group consisting of sheet plastic, chipboard, plywood, cardboard, and corrugated board.

* * * * *